US007322052B2

(12) United States Patent
Alexander

(10) Patent No.: US 7,322,052 B2
(45) Date of Patent: Jan. 29, 2008

(54) DISPENSING APPARATUS FOR A TOILET

(76) Inventor: Douglas E. Alexander, 2870 Arden Dr., Warren, MI (US) 48092

( * ) Notice: Subject to any disclaimer, the term of this patent is extended or adjusted under 35 U.S.C. 154(b) by 0 days.

(21) Appl. No.: 11/608,638

(22) Filed: Dec. 8, 2006

(65) Prior Publication Data

US 2007/0186335 A1 Aug. 16, 2007

Related U.S. Application Data

(60) Provisional application No. 60/748,696, filed on Dec. 8, 2005.

(51) Int. Cl.
*E03D 9/02* (2006.01)

(52) U.S. Cl. ..... 4/223

(58) Field of Classification Search ..... 4/222, 4/223, 231; 222/255, 402.15; 239/274, 239/579

See application file for complete search history.

(56) References Cited

U.S. PATENT DOCUMENTS 3,178,070 A * 4/1965 Leland ..... 222/180
4,670,916 A * 6/1987 Bloom ..... 4/231
6,029,286 A * 2/2000 Funk ..... 4/223
6,178,563 B1 * 1/2001 Helfet ..... 4/213

* cited by examiner

*Primary Examiner*—Tuan Nguyen
(74) *Attorney, Agent, or Firm*—Howard & Howard Attorneys, P.C.

(57) ABSTRACT

The invention provides for a dispensing apparatus removably mounted to a toilet for dispensing a fluid into the toilet to control bathroom odor. The apparatus includes a housing having an open end and a bottom defining a cavity for receiving the fluid. The housing further defines an outlet for communicating the fluid to the toilet. A pump is mounted about the open end of the housing and defines a chamber above the cavity. The chamber is in fluid communication with the cavity and includes a plunger movable within the chamber between actuated and unactuated strokes. The plunger includes at least one aperture in fluid communication with the chamber. The aperture is blocked during the actuated stroke of the plunger for displacing the fluid. The aperture is open during the unactuated stroke of the plunger to equalize pressure within the chamber and the cavity with atmospheric pressure.

20 Claims, 8 Drawing Sheets

DISPENSING APPARATUS FOR A TOILET

CROSS REFERENCE TO RELATED APPLICATION

The subject patent application claims priority to and all the benefits of U.S. Provisional Patent Application No. 60/748,696, which was filed on Dec. 8, 2005, which is hereby incorporated by reference.

BACKGROUND OF THE INVENTION

1. Field of the Invention

The subject invention relates to applying a small quantity of deodorizing liquid within a toilet bowl during a single usage of the toilet bowl.

2. Description of the Prior Art

Bathroom deodorizers are not new. Many attempts have been made to control the odor that is found in a bathroom containing a standard toilet as such odors are offensive and embarrassing. Most commonly, various sprays have been used in the air surrounding the toilet. One prior art method teaches manually spraying the toilet area with an aerosol deodorant spray before and/or after use of the toilet. This method of controlling odors cannot be applied at the source of the odor, a toilet bowl, while the toilet was in use. Additionally, a user is exposed to the chemicals composing the aerosol deodorant. Many consumers do not use these types of aerosol deodorant sprays for these reasons.

These problems led to the development of increasingly complex systems which either filtered or vented the air in the bowl, for example U.S. Pat. No. 3,999,225, or introduced deodorant into the bowl, or a combination of both.

The prior art of filtering escaping odor from within the bowl required complex external fans, ductwork, and power systems. Additionally, venting of the toilet bowl before the odor escaped often required modification of the standard toilet and the placement of unsightly and possibly unsanitary ductwork into the toilet bowl. In addition to being expensive these systems are difficult to install and are not easily removed for cleaning.

Similarly, the prior art of deodorant delivery into the toilet bowl is limited by complexity and its associated cost to effectively stop odor before leaving the toilet bowl. Much of the prior art, for example U.S. Pat. No. 3,420,445, required modification of the standard toilet, required unfavorable external power sources near the toilet, or made cleaning the toilet more difficult.

Many less complicated deodorant delivery systems are ineffective due to methods of activation. One prior art method shown in U.S. Pat. No. 3,605,133 teaches automatically dispensing a deodorizing fluid into the bowl of a toilet having a seat each time the seat is depressed or positioned for use, such as when the user sits on the seat. In this method the fluid may be stored in an aerosol can and sprayed into the bowl or the fluid may be dispensed into the bowl in droplet form from a reservoir located in a remote location. This method cannot discern between movement of the seat intended to dispense the deodorizing fluid and non-usage movement of the seat, for example, such as when cleaning the toilet. These activation methods often produced deodorant regardless of the user's desire or without a way for the user to decide when and how often to activate the system. This results in waste of the fluid due to unintended dispensing. Another problem is that if the user needs to dispense additional deodorizing fluid while utilizing the toilet, the user must unweight the seat enough to allow the dispensing mechanism to recharge which can be awkward.

Therefore, known dispensers for products and known processes for dispensing tend to be complicated, messy (or at least not controllable in the air), not uniform, and limited when an appropriate place to perform the activity is not readily available. Notwithstanding the potential of these prior art attempts to solve the bathroom odor problem, no fully adequate and acceptable solution has been found.

Accordingly there exists a need for an improved toilet deodorizer applicator designed specifically to facilitate the dispensing of the deodorizer or other fluid in a uniform and clean manner into a toilet bowl when desired by the user.

SUMMARY OF THE INVENTION AND ADVANTAGES

The invention provides a dispensing apparatus dispensing a fluid into a toilet. The apparatus includes a housing having an open end and a bottom defining a cavity with the housing further defining an outlet in fluid communication with the cavity for communicating the fluid from the cavity to the toilet. A pump is mounted about the open end of the housing and defines a chamber above the cavity. The chamber is in fluid communication with the cavity and has a plunger movable within the chamber through actuated and unactuated strokes. The plunger has at least one aperture in fluid communication with the chamber. The aperture is blocked during the actuated stroke of the plunger for displacing the fluid within the cavity. The aperture is open during the unactuated stroke of the plunger to equalize pressure within the chamber and the cavity with atmospheric pressure.

Accordingly, the subject invention provides an improved dispensing apparatus that addresses the various problems found in the prior art. The dispensing apparatus of the subject invention allows dispensing of a fluid in a uniform and clean manner when desired by the user

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
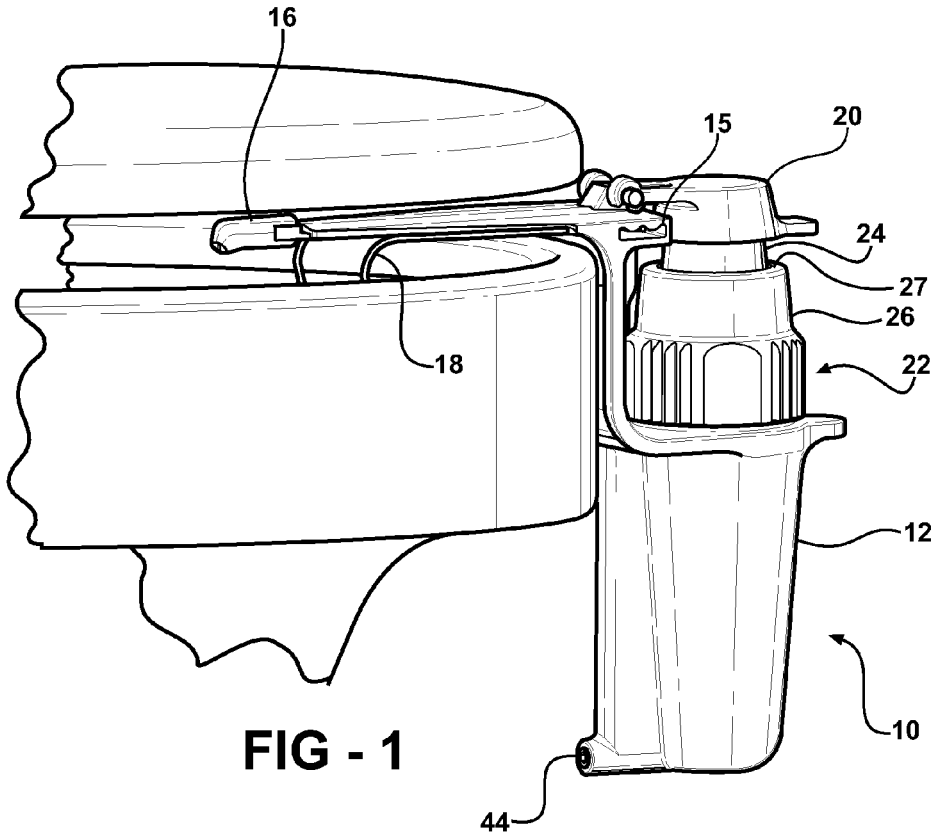
FIG. 1 is a perspective view of a dispensing apparatus for a toilet shown attached to a bowl of a standard toilet.

Referring to the Figures, wherein like numerals indicate corresponding parts throughout the several views, a dispensing apparatus 10 for dispensing a fluid into a toilet is shown generally at 10 in FIG. 1.

Figure 2:
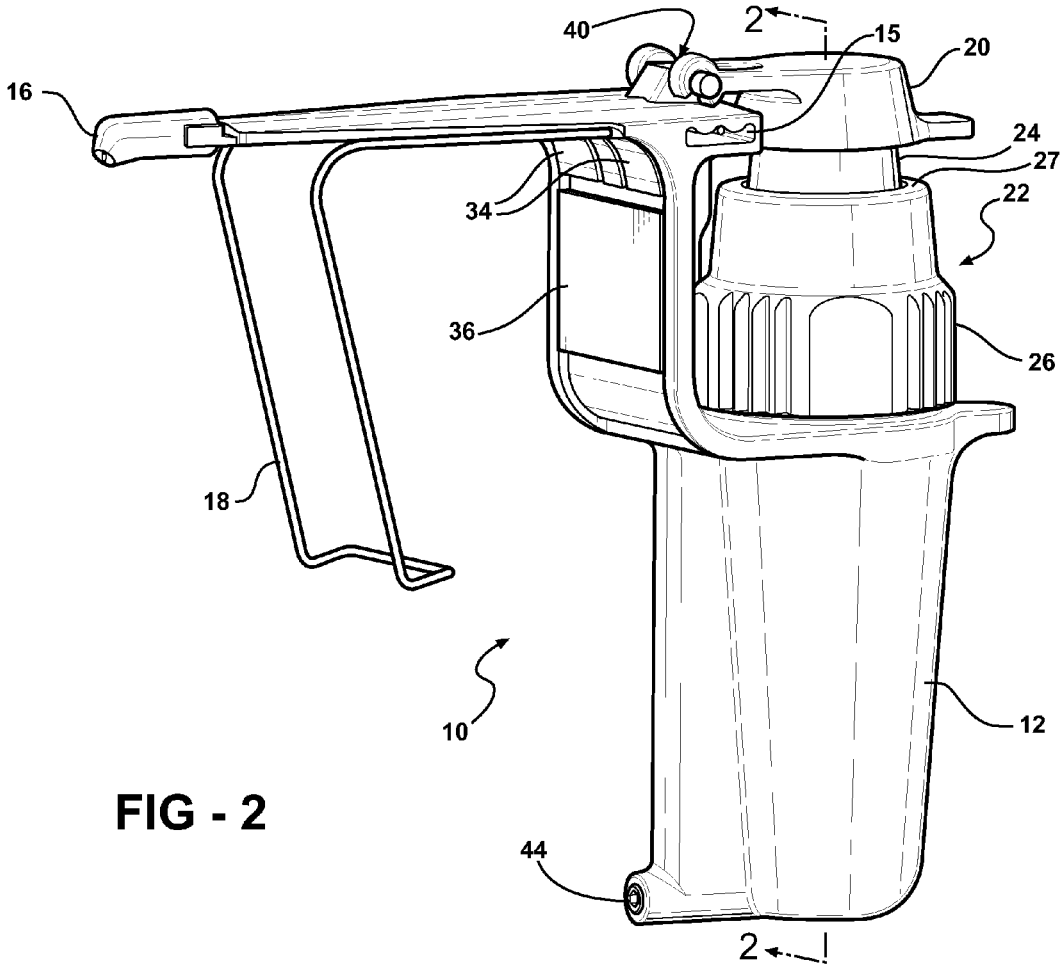
FIG. 2 is a perspective view of a toilet deodorizer applicator apparatus.

Turning to FIG. 2 the dispensing apparatus 10 includes a housing 12 for storing a fluid, such as, for example, a deodorizing fluid, and a nozzle 16 extending from the housing 12 for dispersing the fluid into the toilet bowl. A pump 22 is coupled to the housing 12 for transmitting the fluid stored in the housing 12 to the nozzle 16. The apparatus 10 includes a connecting device 18 coupled to the housing 12 for mounting the housing 12 to the toilet. A pair of retainers 34 are coupled to the housing 12 for supporting the connecting device 18. The nozzle 16 and the connecting device 18 extend away from the housing 12 to fit over a rim 62 of the toilet between a seat 60 and the rim 62. Due to the variety of toilet bowl shapes an adhesive pad 36 mounts to the housing 12 below the pair of retainers 34 to provide additional support to the dispensing apparatus 10. The housing 12 defines at least one detent 15 for adjustably coupling the connecting device 18 to the toilet to accommodate variations in a profile of the rim 62 of the toilet. In the preferred embodiment shown in the Figures, the connecting device 18 is a spring clip having two ends and which conforms to the profile of the rim 62 of the toilet bowl. In the preferred embodiment the housing defines two detents 15 oppositely disposed on the housing 12. The ends of the spring clip engage the detents 15 defined by the housing 12 for adjusting how far the connecting device 18 extends from the housing 12.

Figure 3:
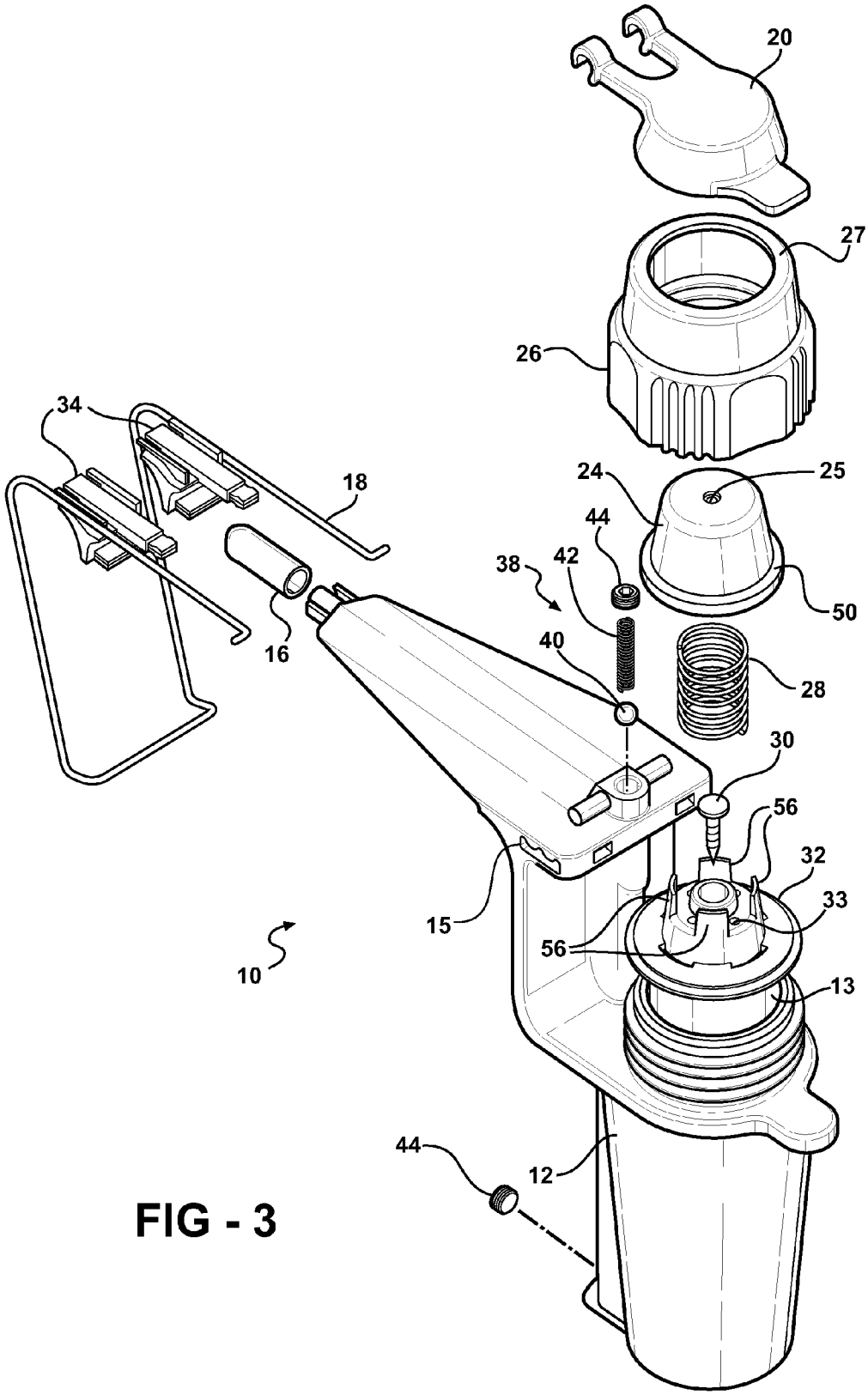
FIG. 3 is an exploded perspective view of the toilet deodorizer applicator apparatus.
Figure 4:
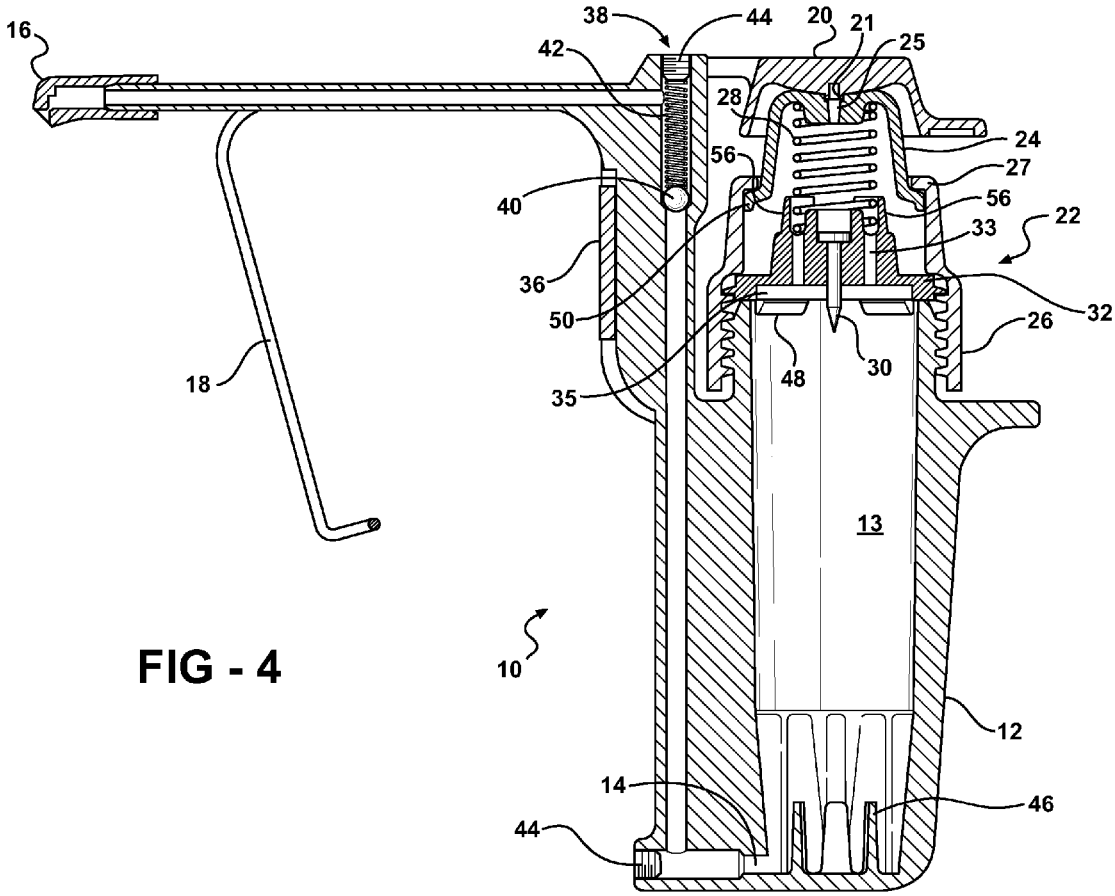
FIG. 4 is a partial cross-sectional side view of the toilet deodorizer applicator apparatus.
Figure 5:
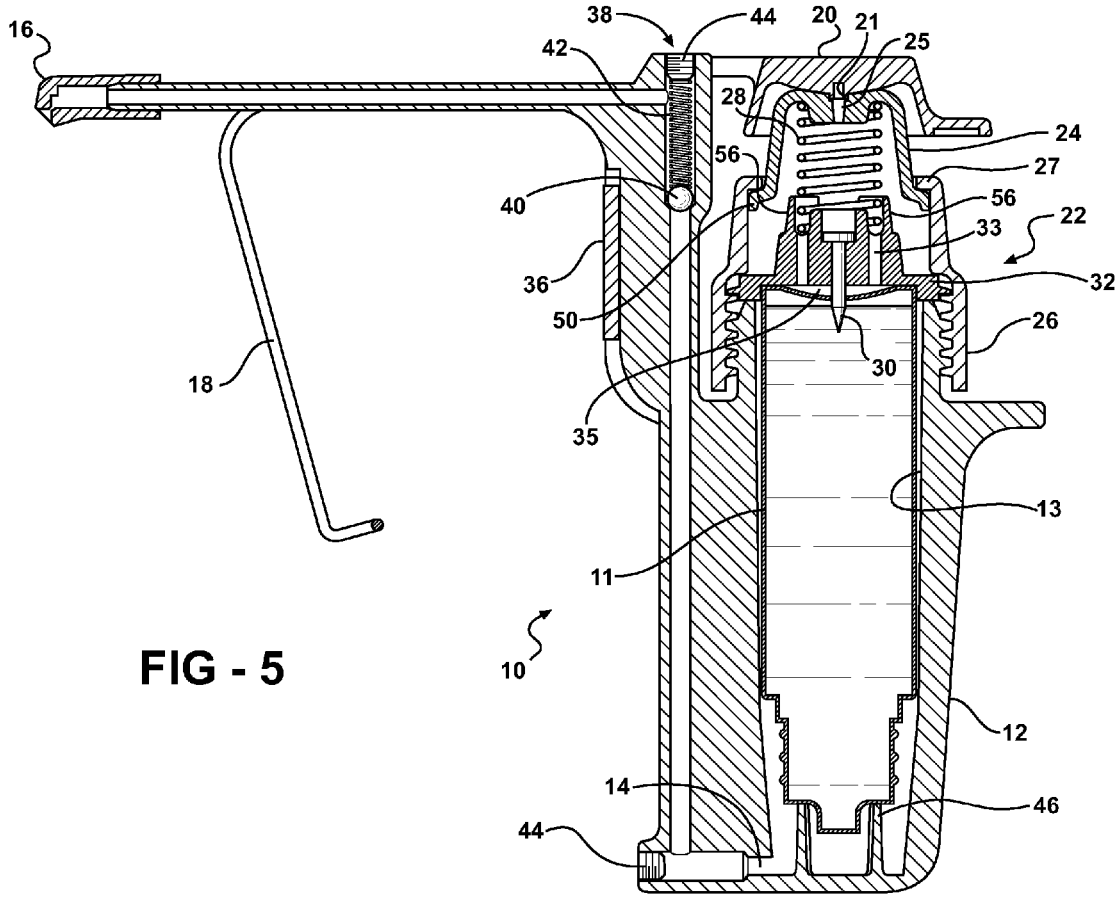
FIG. 5 is a partial cross-sectional side view of the toilet deodorizer applicator apparatus having a container of fluid in a dispensing position.

Referring to FIGS. 3 through 5 the dispensing apparatus 10 is shown in greater detail. The apparatus 10 includes a housing 12 having an open end 34 and a bottom 36 defining a cavity 13 with the housing 12 further defining an outlet 14 in fluid communication with the cavity 13 for communicating the fluid from the cavity 13 of the housing 12 to the toilet. The housing 12 defines an exit passageway 52 in fluid communication with the outlet 14 for transferring the fluid from the cavity 13. The apparatus 10 includes the nozzle 16 which is in fluid communication with the exit passageway 52 for delivering the fluid from the cavity 13 to the toilet. A check valve 38 disposed in the exit passageway 52 for permitting fluid flow through the exit passageway 52 when the plunger 24 moves through the actuated stroke. As shown in FIG. 3, the check valve 38 includes a ball 40 and a spring 42 and the check valve 38 is secured within the housing 12 using a set screw 44. However, it should be understood that the check valve 38 may be any suitable type as known to those having ordinary skill in the art. The spring 42 is used to control the volume of fluid flowing through the passageway. Substituting springs having different spring rates will vary the volume of fluid permitted past the check valve 38. It is contemplated that the ball 40 be made of metal or plastic, however, it should be understood that the ball 40 may be of any suitable material as known to those having ordinary skill in the art.

Figure 6:
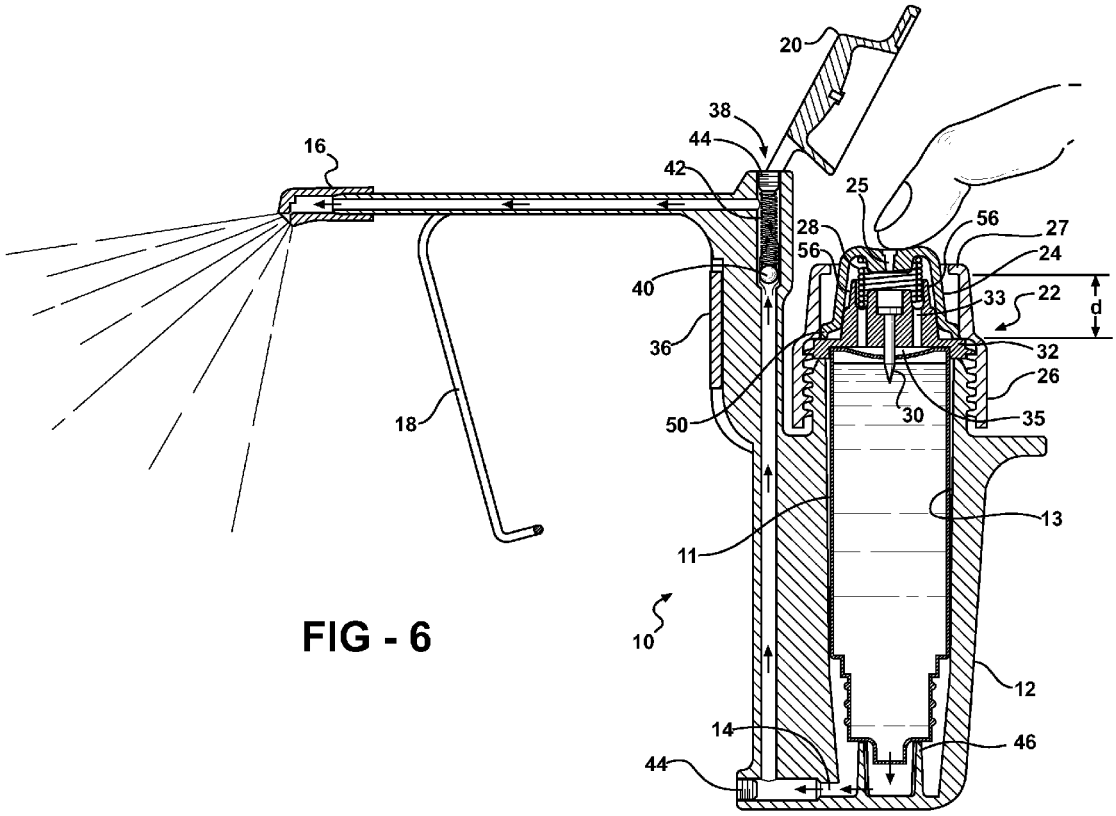
FIG. 6 is a partial cross-sectional side view of the toilet deodorizer applicator apparatus showing a dispensing action.

The apparatus includes a pump 22 mounted about the open end 34 of the housing 12. The pump 22 defines a chamber 54 above the cavity 13 with the chamber 54 in fluid communication with the cavity 13. The pump 22 further includes a plunger 24 which is movable within the chamber 54 through an actuated and unactuated stroke. FIGS. 3 through 5 show the plunger 24 in the unactuated stroke position. FIG. 6 shows the plunger 24 in the actuated stroke position. A distance between the actuated and unactuated stroke is generally shown at d in FIGS. 6 through 10. The apparatus includes a cover 20 connected to the housing 12 and movable between an open position exposing the plunger 24 and a closed position concealing at least a portion of the plunger 24 for protecting the plunger from contamination by foreign matter.

The plunger 24 has at least one aperture 25 in fluid communication with the chamber 54 with the aperture 25 being blocked during the actuated stroke of the plunger 24 for displacing the fluid within the cavity 13 and the aperture 25 being open during the unactuated stroke of the plunger 24 for equalizing pressure within the chamber 54 and the cavity 13 with atmospheric pressure. The plunger 24 further includes a shoulder 50 for engaging the lip 27 to retain the plunger 24 in the chamber 54 when the plunger 24 is in an unactuated position. In a preferred embodiment the aperture 25 is further defined as a single aperture 25 centrally disposed on the plunger 24. The plunger 24 is preferably formed of a rigid material. An alternative embodiment contemplates that the plunger 24 is formed of a flexible material and has a bulb-shaped configuration. However, it should be understood that any suitable configuration of the plunger 24 known to those having ordinary skill in the art may be used.

The pump 22 includes a divider 32 mounted to the housing 12. The pump 22 is disposed between the cavity 13 and the chamber 54 with the divider 32 defining at least one hole 33 which provides fluid communication between the cavity 13 and the chamber 54 for transmitting pressure between the chamber 54 and the cavity 13. The pump 22 includes a sleeve 26 disposed about the housing 12 with the sleeve 26 having a lip 27 for retaining the plunger 24 within the chamber 54 and for defining the strokes d of the plunger 24 between the lip 27 and the divider 32. The pump 22 further includes a biasing device 28 mounted between the divider 32 and the plunger 24 for continuously biasing the plunger 24 away from the divider 32. As best shown in FIG. 3, a plurality of spring supports 56 project from the divider 32 for receiving the biasing device 28.

Referring to FIG. 5, it is contemplated that the dispensing apparatus 10 includes a container 11 disposed within the cavity 13. The dispensing apparatus 10 defines at least one opening in fluid communication with the cavity 13 for storing the fluid. The assembly further includes a piercing member 30 which is coupled to the divider 32 for puncturing the container 11 to define an orifice in the container 11 with the container 11 being in fluid communication with the chamber 54 through the orifice. When the container 11 is empty the container 11 remains coupled to the piercing member 30 for easy removal from the housing 12. The divider 32 further defines a cutout 35 in fluid communication with the hole 33 for transmitting pressure between the chamber 54 and the cavity 13 when the container 11 is engaged with the piercing member and the cavity 13.

Turning to FIG. 6 the dispensing apparatus 10 is shown in with the plunger 24 in an actuated position and the fluid being dispensed from the nozzle. It is contemplated that the nozzle 16 has at least one port 17 for dispensing the fluid from the exit passageway to the toilet. It is further contemplated that the number, placement and shape of the ports 17 may be varied to control fluid pressure and spray pattern.

Figure 7:
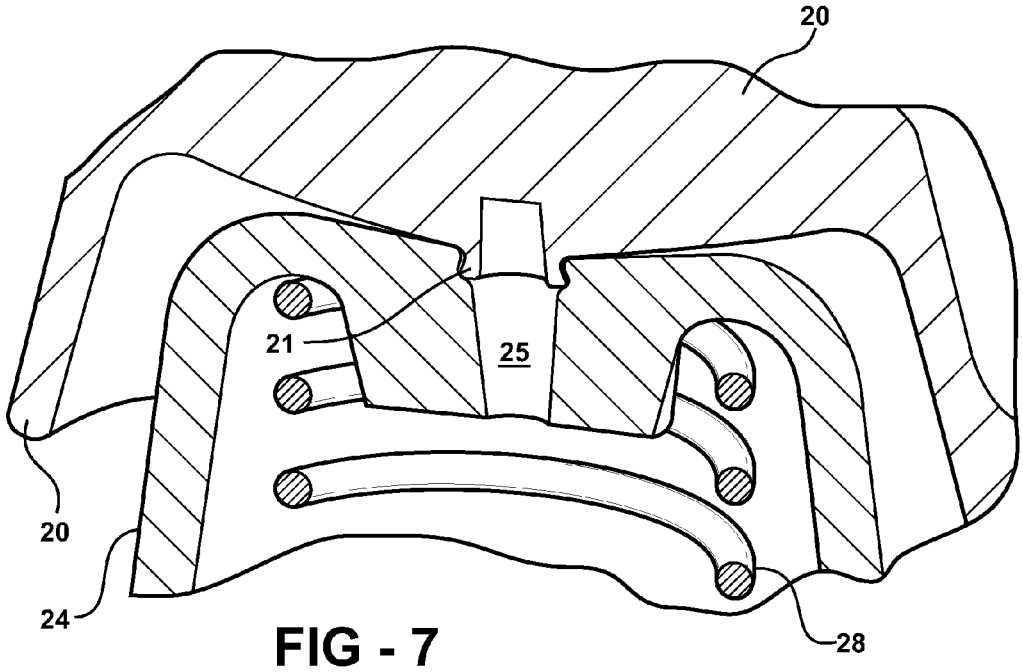
FIG. 7 is an enlarged partial cross-sectional side view of a nipple on a cover in a closed position engaging a plunger.

However, it should be understood that any number, placement and shape of the ports 17 known to those of ordinary skill in the art may be used The cover 20 further includes a projection 21 for engaging the aperture 25 when the cover 20 is in the closed position to seal the chamber 54 and the cavity 13 as shown in FIG. 7. The cover 20 defines a recess 23 complementary in configuration to the plunger 24 for surrounding a portion of the plunger 24.

Figure 8:
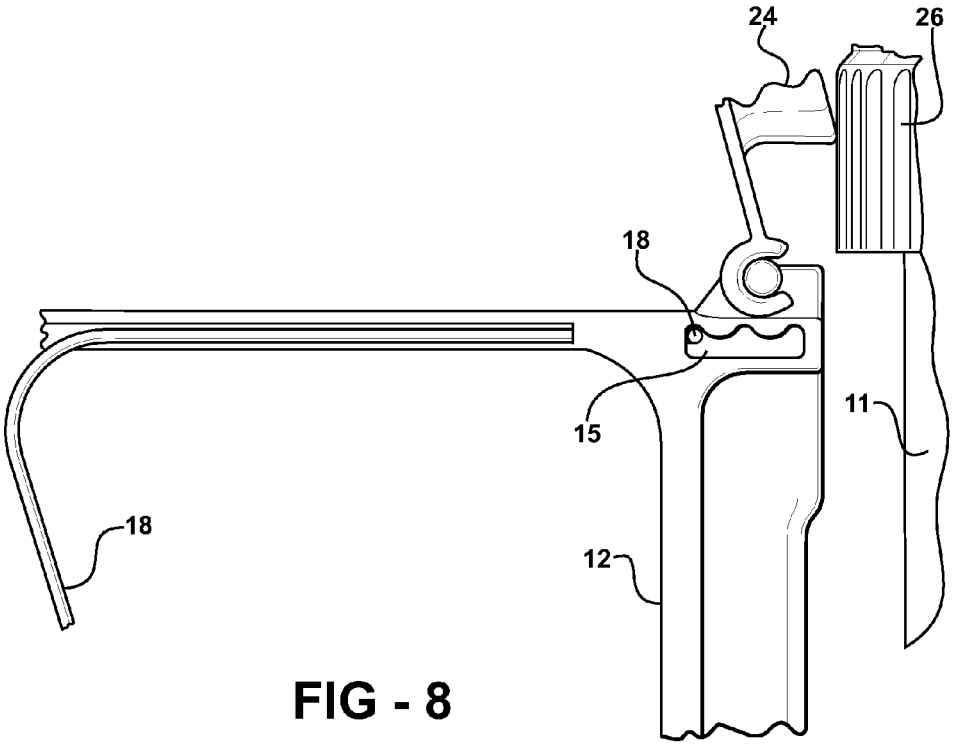
FIG. 8 is a side view of a clip in an extended position with the cover in a fully open position.
Figure 9:
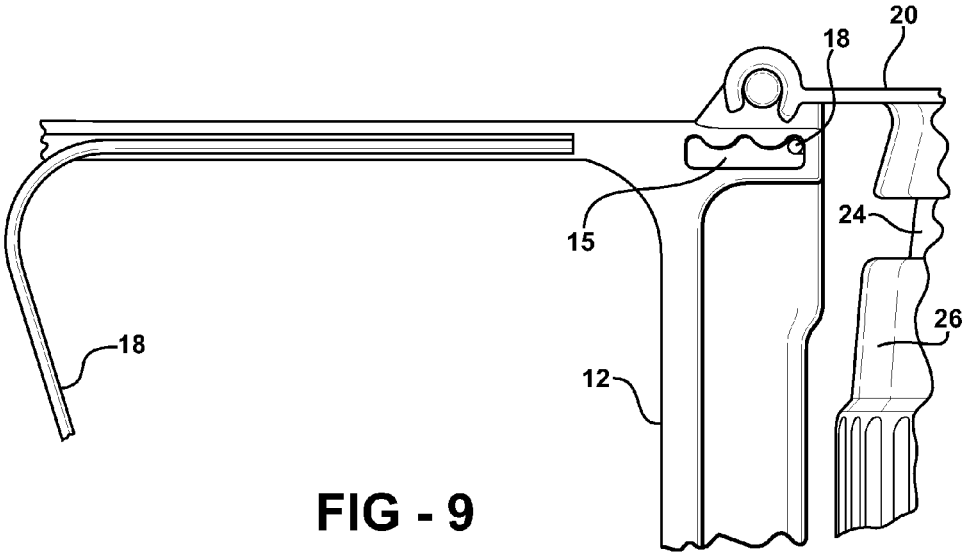
FIG. 9 is a side view of the clip in a retracted position with the cover in a fully closed position.

FIGS. 8 and 9 show the connecting device 18 in a preferred embodiment of a spring clip engaging the detents 15. In the preferred embodiment the detents 15 allow the spring clip to adjust to three positions. FIG. 8 shows the spring clip in a first position to provide a maximum reach for the spring clip with the cover 20 in the open position with the sleeve 26 coupled to a container 11 and shown partially inserted into the housing 12. FIG. 9 shows the spring clip in a second position to provide a minimum reach for the spring clip. FIG. 9 shows the cover 20 in the closed position covering the plunger 24.

Figure 10A:
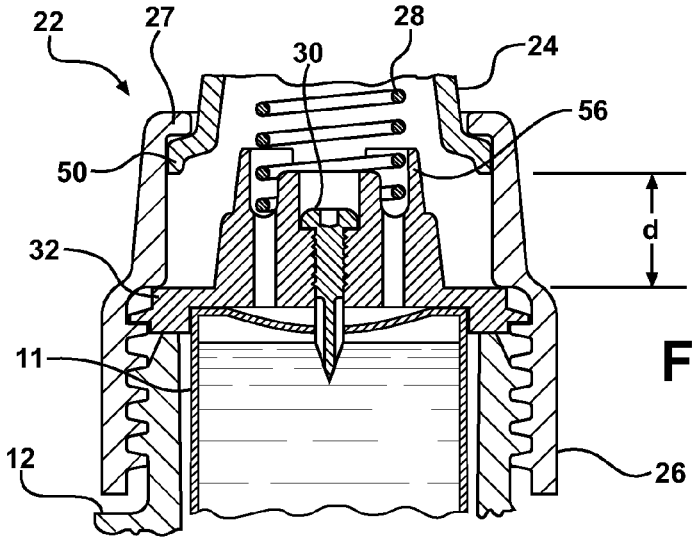
FIG. 10A is a partial cross-sectional side view of one embodiment of a piercing member.
Figure 10B:
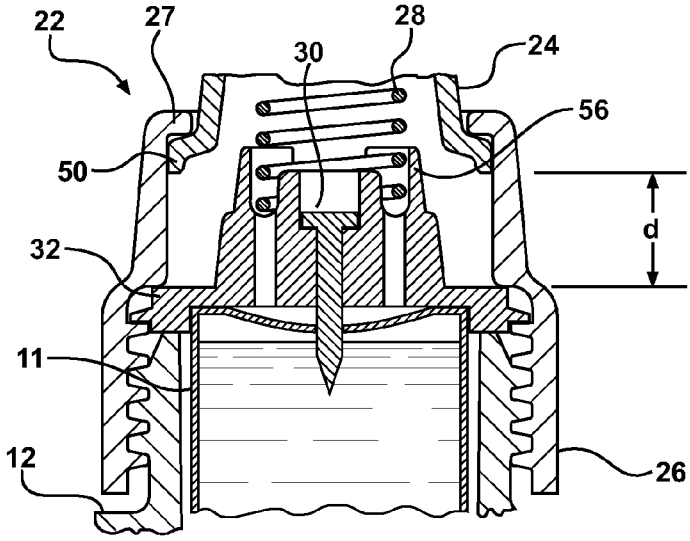
FIG. 10B is a partial cross-sectional side view of a second embodiment of a piercing member.
Figure 10C:
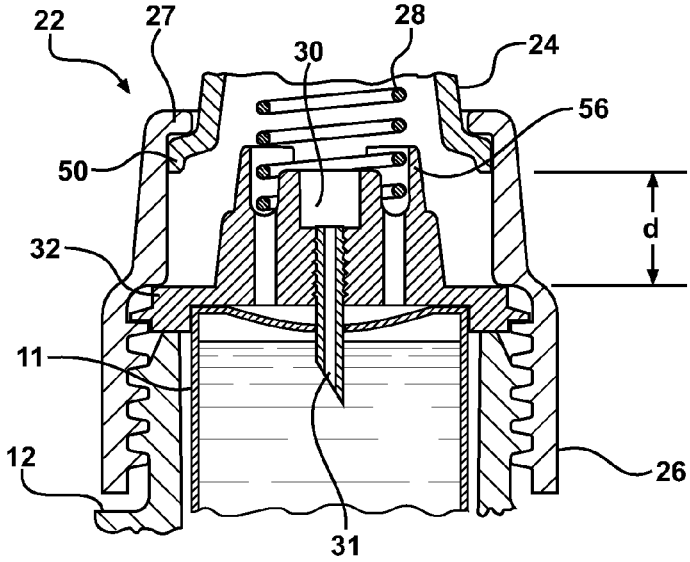
FIG. 10C is a partial cross-sectional side view of a third embodiment of a piercing member.

FIGS. 10A through 10C show alternative embodiments of the piercing member 62. It is contemplated that the piercing member 30 be a screw, as shown in FIG. 10A, or a grooved nail, as shown in FIG. 10B for puncturing the container 11 to define an orifice in the container 11 with the container 11 being in fluid communication with the chamber 54 through the orifice. Alternatively, as shown in FIG. 10C, the piercing member 30 defines a lumen 31 for facilitating fluid communication through the orifice. However, it should be understood that the piercing member 30 may be of any suitable type as known to those having ordinary skill in the art.

The foregoing invention has been described in accordance with the relevant legal standards; thus, the description is exemplary rather than limiting in nature. Variations and modifications to the disclosed embodiments may become apparent to those having ordinary skill in the art and do come within the scope of the invention. Accordingly, the scope of legal protection afforded this invention can only be determined by studying the following claims.

What is claimed is:

1. A dispensing apparatus for dispensing a fluid into a toilet, said apparatus comprising;

a housing having an open end and a bottom defining a cavity with said housing further defining an outlet in fluid communication with said cavity for communicating the fluid from said cavity to the toilet, a pump mounted about said open end of said housing defining a chamber above said cavity with said chamber in fluid communication with said cavity and having a plunger movable within said chamber through actuated and unactuated strokes, and said plunger having at least one aperture in fluid communication with said chamber with said aperture being blocked during said actuated stroke of said plunger for displacing the fluid within said cavity and said aperture being open during said unactuated stroke of said plunger for equalizing pressure within said chamber and said cavity with atmospheric pressure.

2. An apparatus as set forth in claim 1 wherein said at least one aperture is further defined as a single aperture centrally disposed on said plunger.

3. An apparatus as set forth in claim 1 wherein said pump includes a divider mounted to said housing and disposed between said cavity and said chamber with said divider defining at least one hole providing fluid communication between said cavity and said chamber for transmitting pressure between said chamber and said cavity.

4. An apparatus as set forth in claim 3 wherein said pump includes a biasing device mounted between said divider and said plunger for continuously biasing said plunger away from said divider.

5. An apparatus as set forth in claim 4 wherein said pump includes a sleeve disposed about said housing with said sleeve having a lip for retaining said plunger within said chamber and for defining said strokes of said plunger between said lip and said divider.

6. An apparatus as set forth in claim 5 wherein said plunger further includes a shoulder for engaging said lip to retain said plunger in said chamber.

7. An apparatus as set forth in claim 3 further including a container disposed within said cavity and defining at least one opening in fluid communication with said cavity.

8. An apparatus as set forth in claim 7 further including a piercing member coupled to said divider for puncturing said container to define an orifice in said container with said container being in fluid communication with said chamber through said orifice.

9. An apparatus as set forth in claim 8 wherein said piercing member defines a lumen for facilitating fluid communication through said orifice.

10. An apparatus as set forth in claim 3 wherein said divider further defines a cutout in fluid communication with said hole.

11. An apparatus as set forth in claim 1 wherein said plunger is formed of a flexible material and has a bulb-shaped configuration.

12. An apparatus as set forth in claim 1 wherein said plunger is formed of a rigid material.

13. An apparatus as set forth in claim 1 further including a cover connected to said housing and movable between an open position exposing said plunger and a closed position concealing at least a portion of said plunger for protecting said plunger from contamination by foreign matter.

14. An apparatus as set forth in claim 13 wherein said cover further includes a projection for engaging said aperture when said cover is in said closed position to seal said chamber and said cavity.

15. An apparatus as set forth in claim 13 wherein said cover defines a recess complementary in configuration to said plunger for surrounding a portion of said plunger.

16. An apparatus as set forth in claim 1 wherein said housing defines an exit passageway in fluid communication with said outlet for transferring the fluid from said cavity.

17. An apparatus as set forth in claim 16 further including a check valve disposed in said exit passageway for permitting fluid flow through said exit passageway when said plunger moves through said actuated stroke.

18. An apparatus as set forth in claim 16 further including a nozzle in fluid communication with said exit passageway for delivering the fluid from said cavity to the toilet.

19. An apparatus as set forth in claim 1 further including a connecting device coupled to said housing for mounting said housing to the toilet.

20. An apparatus as set forth in claim 19 wherein said housing defines at least one detent for adjustably coupling said connecting device to the toilet.

* * * * *